US006402233B1

(12) United States Patent
Tseng

(10) Patent No.: US 6,402,233 B1
(45) Date of Patent: Jun. 11, 2002

(54) SWING ASSEMBLY WITH ADJUSTABLE CANOPY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 10 days.

(21) Appl. No.: 09/619,787

(22) Filed: Jul. 20, 2000

(51) Int. Cl.[7] ..... A63G 9/00

(52) U.S. Cl. ..... 297/184.1; 297/184.15; 297/273; 297/277; 297/280; 297/281; 472/118; 472/125

(58) Field of Search ..... 297/184.1, 184.15, 297/273, 276, 277, 280, 281; 472/118, 125

(56) References Cited

U.S. PATENT DOCUMENTS 603,311 A * 5/1898 Andrews ..... 297/184.15
1,247,577 A * 11/1917 Rodd ..... 297/184.1 X
2,300,586 A * 11/1942 Meehan ..... 297/184.15 X
2,848,229 A * 8/1958 Miller ..... 297/184.15 X
4,351,524 A * 9/1982 Gomes ..... 297/280 X
5,564,987 A * 10/1996 Ayrolles ..... 472/118
5,803,818 A * 9/1998 Tseng ..... 472/118
5,957,780 A * 9/1999 Grazioli
6,001,021 A * 12/1999 Battaglia ..... 297/281 X
6,036,605 A * 3/2000 Tseng ..... 297/281 X

* cited by examiner

*Primary Examiner*—Peter M. Cuomo
*Assistant Examiner*—Rodney B. White
(74) *Attorney, Agent, or Firm*—Ladas & Parry

(57) ABSTRACT

A swing assembly includes a support frame unit with lateral frames and a horizontal bar interconnecting the lateral frames, a canopy frame with a pair of lateral rods perpendicular to the horizontal bar, and a pair of adjustable mounting units. Each of the mounting units includes a retaining member secured to the lateral rod, and having a first axle hole and a first end face formed with first engagement teeth around the first axle hole. A stationary seat on the horizontal bar has a second axle hole aligned with the first axle hole, and a second end face confronting the first end face and formed with second engagement teeth around the second axle hole. A pivot axle is secured to the lateral rod, extends through the first and second axle holes, and has a threaded end projecting through the stationary seat and engaging a rotary knob. The rotary knob is operable in a first direction to enable engagement between the first and second engagement teeth so as to prevent rotation of the retaining member relative to the stationary seat, and in a second direction to release the first engagement teeth from the second engagement teeth and permit rotation of the retaining member relative to the stationary seat.

3 Claims, 7 Drawing Sheets

SWING ASSEMBLY WITH ADJUSTABLE CANOPY

BACKGROUND OF THE INVENTION

1. Field of the Invention

The present invention relates to a swing assembly, more particularly to a swing assembly having a canopy with an adjustable inclination.

2. Description of the Related Art

FIGS. 1 and 2 illustrate a conventional swing assembly which includes a pair of spaced-apart lateral frames 11 (only one is shown), a horizontal bar 116 interconnecting upper ends of the lateral frames 11, a seat unit 12 disposed among the lateral frames 11 and the horizontal bar 116, a pair of linking units 120 (only one is shown) for connecting the seat unit 12 to the horizontal bar 116, and a canopy 13. Each of the lateral frames 11 includes a lower frame portion 111 and an upper insert rod 117 which extends vertically and which is secured to one end of the horizontal bar 116. The lower frame portion 111 has a front leg 111A and a rear leg 113 fastened to the front leg 111A by means of two fasteners 112. The front leg 111A has a tubular connecting portion 111B that defines an open upper end of the front leg 111A. The insert rod 117 has a restricted lower end 117A extending axially into the upper end of the tubular connecting portion 111B. A pair of screw fasteners 118 extend transversely through the tubular connecting portion 111B and the restricted lower end 117A of the insert rod 117 for fastening the insert rod 117 to the tubular connecting portion 111B. An inclined hanger rod 119 extends between the horizontal bar 116 and a respective one of the insert rod 117 adjacent to the corner of the horizontal bar 116 and the respective insert rod 117. Each of the linking units 120 includes front and rear linking rods 124, 125 which have lower ends connected pivotally to the seat unit 12, and a hook member 110 mounted on a respective one of the hanger rods 119 and connected to upper ends of the front and rear linking rods 124, 125. The canopy 13 includes a rectangular canopy frame 131 which has parallel lateral rods 133 disposed above the horizontal bar 116 and welded to upper ends of the insert rods 117, and which has a canopy member 132 mounted thereon.

The following are some of the drawbacks of the conventional swing assembly: First, as the canopy frame 131 is welded to the upper ends of the insert rods 117, it is not possible to adjust the inclination of the canopy 13 to achieve the desired sun-blocking effect. Second, since the weights of the seat unit 12 and a person seated on the seat unit 12 are applied to the insert rods 117 and the horizontal bar 116 via the hanger rods 119, and since the insert rods 117 are fastened to the tubular connecting portions 111B of the front legs 111A merely by means of two screw fasteners 118, the connection between the insert rods 117 and the tubular connecting portions 111B is not strong enough.

SUMMARY OF THE INVENTION

Therefore, the main object of the present invention is to provide a swing assembly having a canopy with an adjustable inclination and a more durable construction.

Accordingly, the swing assembly of the present invention includes a support frame unit, a seat unit, a pair of linking units, a canopy frame and a pair of adjustable mounting units. The support frame unit includes a pair of spaced-apart lateral frames with lower end portions adapted to be supported on a ground surface, and upper end portions, and a horizontal bar interconnecting the upper end portions of the lateral frames. The seat unit is disposed among the lateral frames and the horizontal bar. The linking units are spaced apart along a longitudinal direction of the horizontal bar. Each of the linking units has an upper end connected pivotally to the horizontal bar, and a lower end connected pivotally to the seat unit, and thereby suspending the seat unit above the ground surface. The canopy frame has a pair of lateral rods which are spaced-apart in the longitudinal direction of the horizontal bar, and which are perpendicular to the horizontal bar. Each of the adjustable mounting units mounts a respective one of the lateral rods on the horizontal bar, and includes a retaining member, a stationary seat, a pivot axle and an operable rotary knob. The retaining member is secured to the respective one of the lateral rods. The retaining member has a first axle hole formed therethrough, and a first end face formed with a series of first engagement teeth around the first axle hole. The stationary seat is secured to the horizontal bar, and is disposed adjacent to the retaining member. The stationary seat has a second axle hole formed therethrough. The second axle hole is aligned with the first axle hole. The stationary seat further has a second end face that confronts the first end face and that is formed with a series of second engagement teeth around the second axle hole for engaging the first engagement teeth. The pivot axle has a first end secured to the respective one of the lateral rods, and a threaded second end which extends from the first end in a direction transverse to the respective one of the lateral rods through the first and second axle holes and the stationary seat. The rotary knob is disposed adjacent to the stationary seat opposite to the second end face and threadedly engages the second end of the pivot axle. The rotary knob is operable in a first direction for threading toward the stationary seat to abut against the stationary seat so as to enable the first end face of the retaining member to contact tightly the second end face of the stationary seat and to enable the first engagement teeth to engage the second engagement teeth, thereby preventing rotation of the retaining member relative to the stationary seat about an axis of said pivot axle to prevent in turn rotation of the lateral rods of the canopy frame relative to the horizontal bar. The rotary knob is further operable in a second direction opposite to the first direction for threading away from the stationary seat, thereby releasing the first engagement teeth of the retaining member from the second engagement teeth of the stationary seat, and thereby permitting rotation of the retaining member together with the respective one of the lateral rods relative to the stationary seat and the horizontal bar so as to permit tilting adjustment of the canopy frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
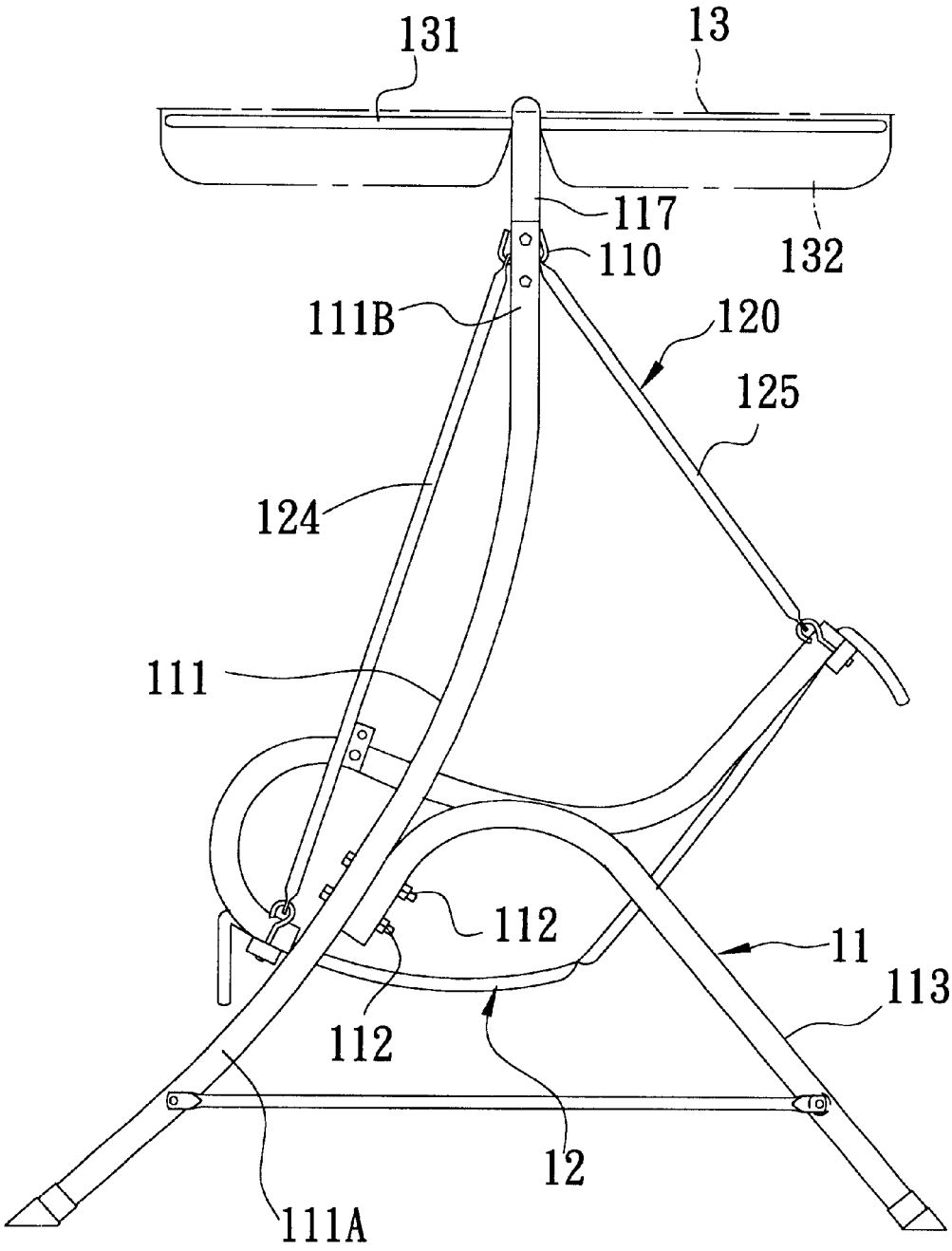
FIG. 1 PRIOR ART
FIG. 1 is a side view of a conventional swing assembly.
Figure 2:
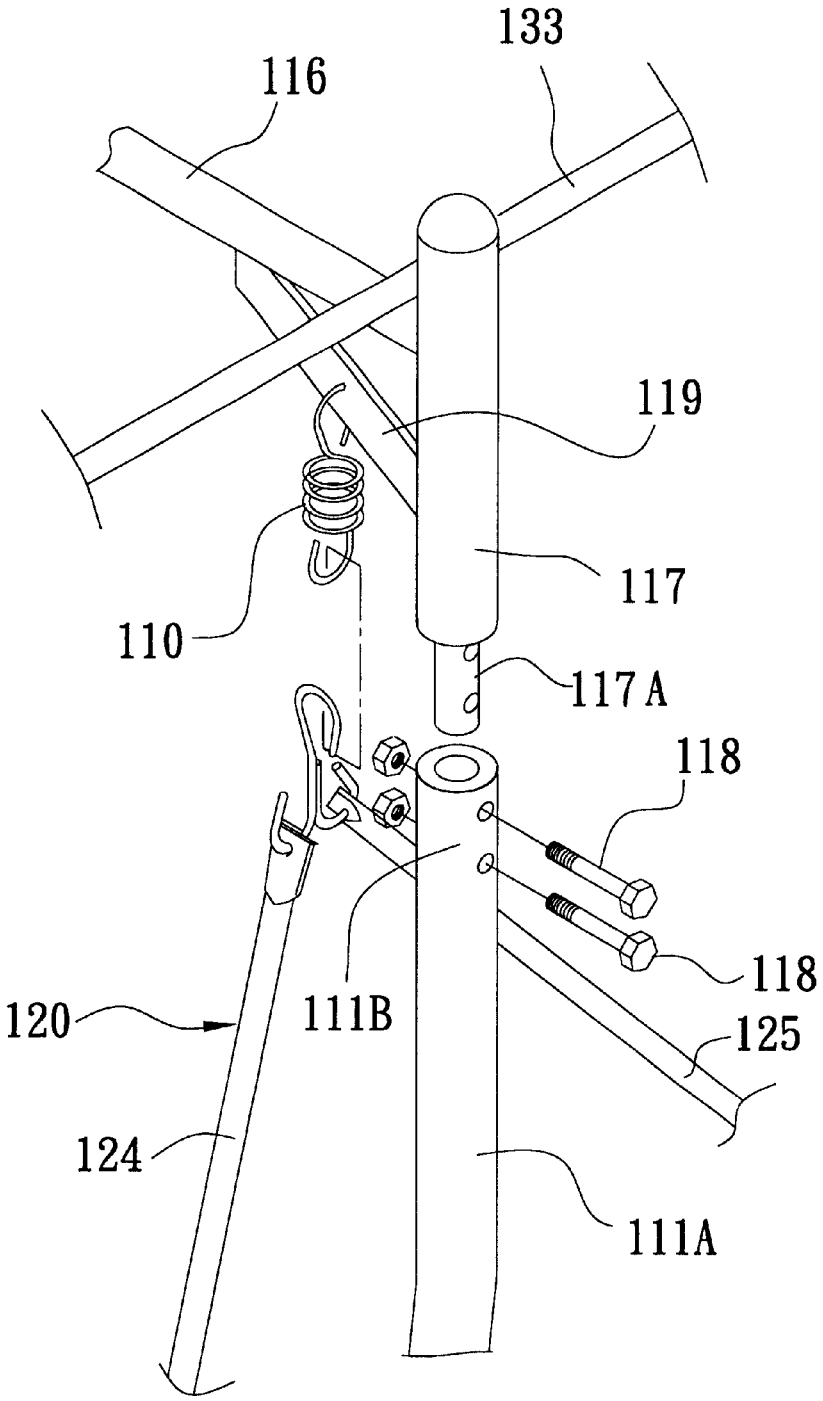
FIG. 2 PRIOR ART
FIG. 2 is a partly exploded, fragmentary perspective view of the conventional swing assembly.
Figure 3:
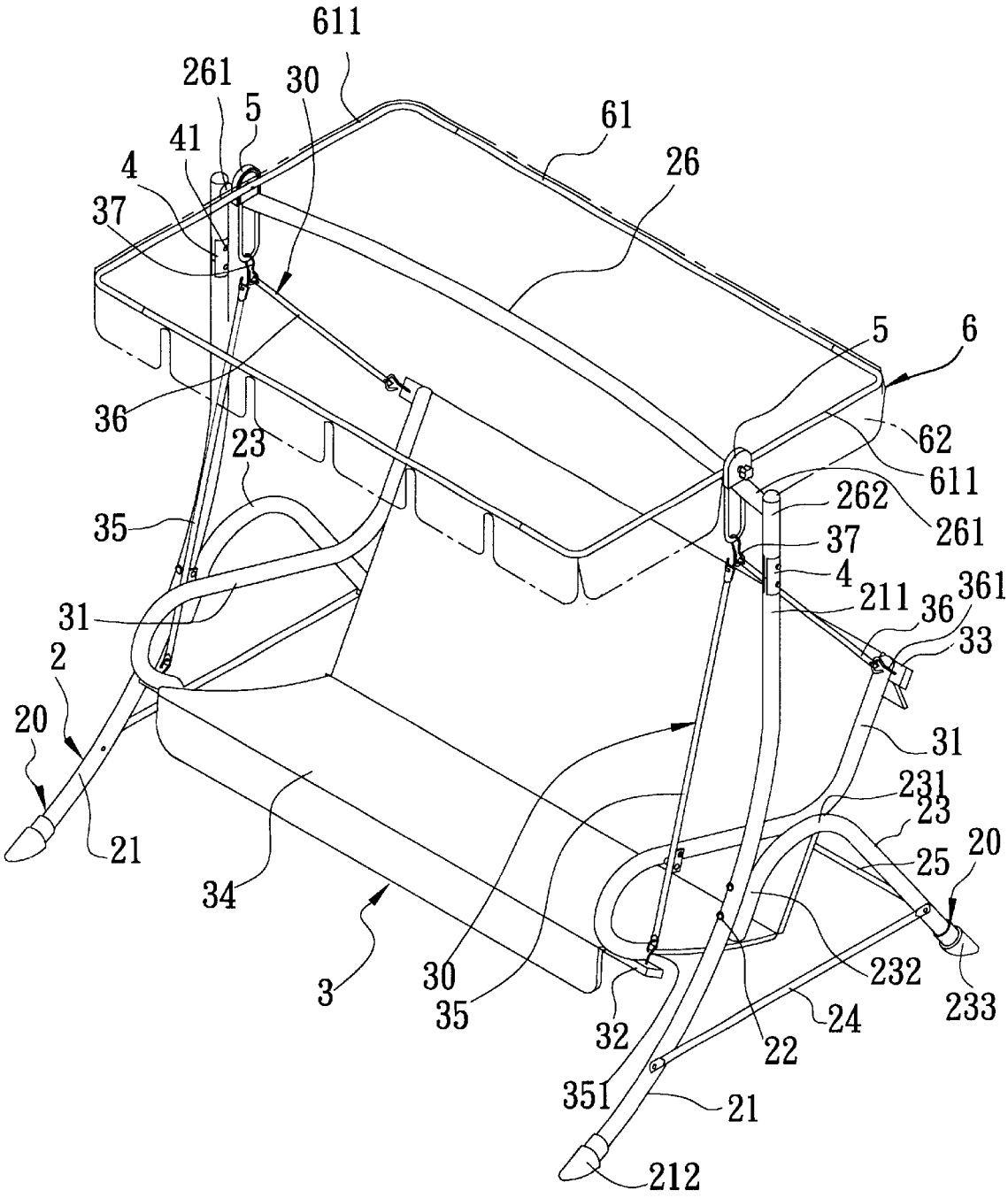
FIG. 3 is a perspective view of a preferred embodiment of the swing assembly of the present invention.
Figure 4:
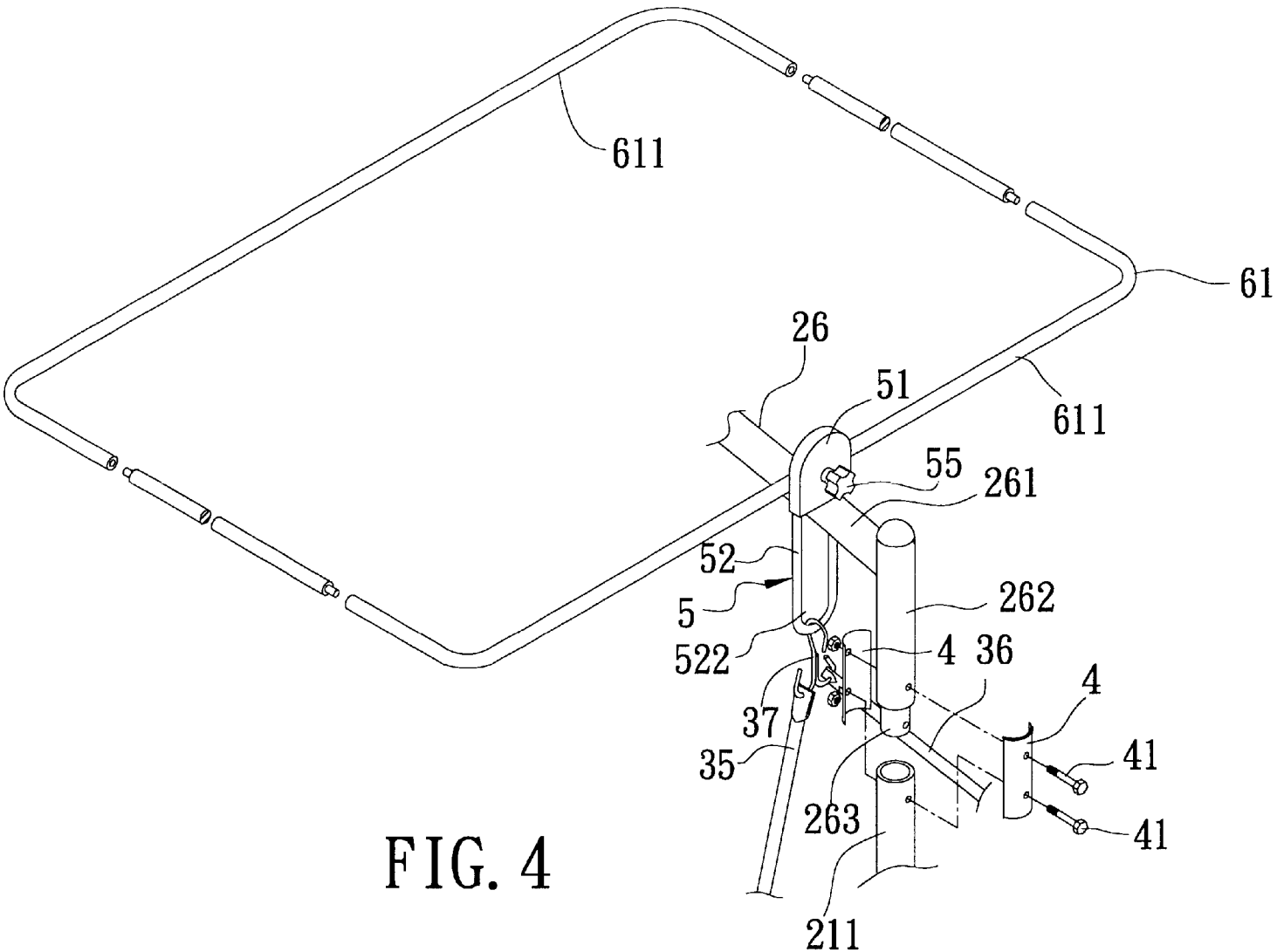
FIG. 4 is a partly exploded, fragmentary perspective view of the preferred embodiment.

Referring to FIGS. 3 and 4, the preferred embodiment of the swing assembly of the present invention is shown to include a support frame unit 2, a seat unit 3, a pair of linking units 30, a canopy 6, and a pair of adjustable mounting units 5.

The support frame unit 2 includes a pair of lateral frames 20, and a horizontal bar 26 interconnecting upper ends of the lateral frames 20. Each of the lateral frames 20 has a front leg 21 with a lower end 212 adapted to be supported on a ground surface, and a tubular connecting part 211 which defines an open upper end of the front leg 21. Each of the lateral frames 20 further has a rear leg 23 with a curved section 231, a downwardly and forwardly extending front end 232 of which is fastened to the front leg 21 by means of screw fasteners 22, and a rear end 233 adapted to be supported on the ground surface. Each of the lateral frames 20 further includes a lateral linking rod 24 which extends horizontally between the front and rear legs 21, 23 for interconnecting the same. The support frame unit 2 further includes a rear linking rod 25 which extends horizontally between the rear legs 23 of the lateral frames 20 for interconnecting the same. Each of the lateral frames 20 further includes a vertical insert rod 262 which is secured to a respective one of two opposite end portions 261 of the horizontal bar 26. The insert rod 262 has a restricted lower end 263 inserted axially into the open upper end of the tubular connecting part 211 of the front leg 21. A pair of curved reinforcing plates 4 have curvatures complementing the outer circumferences of the insert rod 262 and the tubular connection part 211, and cooperatively embrace a juncture of the insert rod 262 and the tubular connecting part 211. A pair of screw fasteners 41, which are spaced-apart in a vertical direction, extend transversely through the reinforcing plates 4, the insert rod 262 and the tubular connecting part 211 for fastening together the same.

The seat unit 3 is disposed in a swing space confined by the horizontal bar 26 and the lateral frames 20 of the support frame unit 2. The seat unit 3 includes a horizontal front connecting rail 32, a horizontal rear connecting rail 33 disposed at a level higher than the front connecting rail 32, a fabric piece 34 mounted on the front and rear connecting rails 32, 33 so as to form a seat, and a pair of lateral arms 31 which are proximate to the lateral frames 20 of the support frame unit 2 and which interconnect end portions of the front and rear connecting rails 32, 33.

The linking units 30 are spaced-apart along a longitudinal direction of the horizontal bar 26. Each of the linking units 30 is disposed between one of the lateral arms 31 and an adjacent one of the lateral frames 20 of the support frame unit 2, and includes front and rear linking rods 35, 36. The front linking rod 35 has an upper end hooked onto a three-ended upper hook member 37, a lower end connected pivotally to the front connecting rail 32 by a front hook member 351, and an intermediate portion connected pivotally to an adjacent one of the lateral arms 31. The rear linking rod 36 has an upper end hooked onto the three-ended upper hook member 37, and a lower end connected pivotally to the rear connecting rail 33 by means of a rear hook member 361.

The canopy 6 includes a rectangular canopy frame 61 disposed over the horizontal bar 26 and between the end portions 261 of the horizontal bar 26, and a canopy member 62 (shown in phantom lines in FIG. 3) mounted on the canopy frame 61. The canopy frame 61 includes a pair of lateral rods 611 which are spaced-apart in the longitudinal direction of the horizontal bar 26 and which are perpendicular to the horizontal bar 26.

Figure 5:
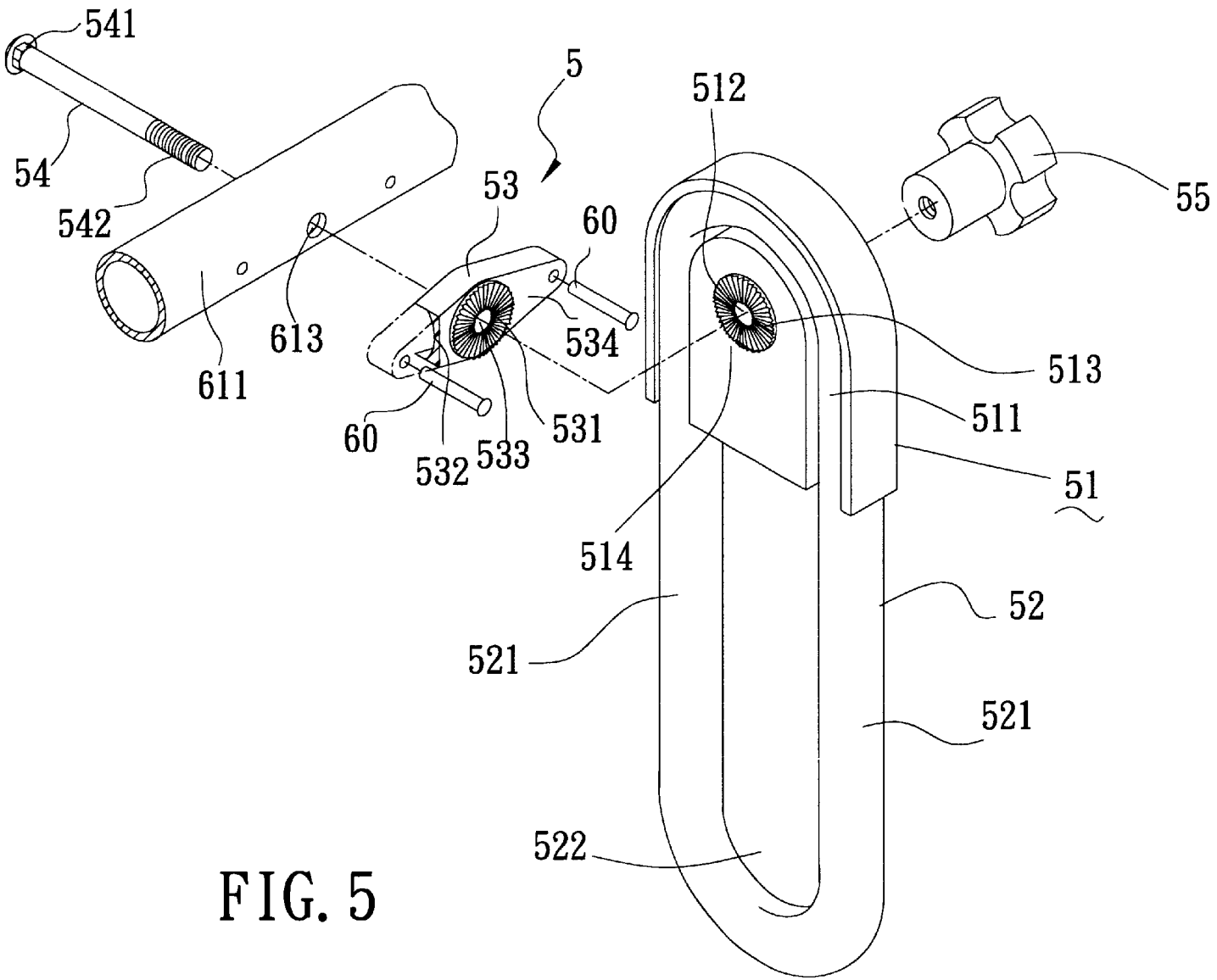
FIG. 5 is an exploded perspective view illustrating an adjustable mounting unit of the preferred embodiment.
Figure 6:
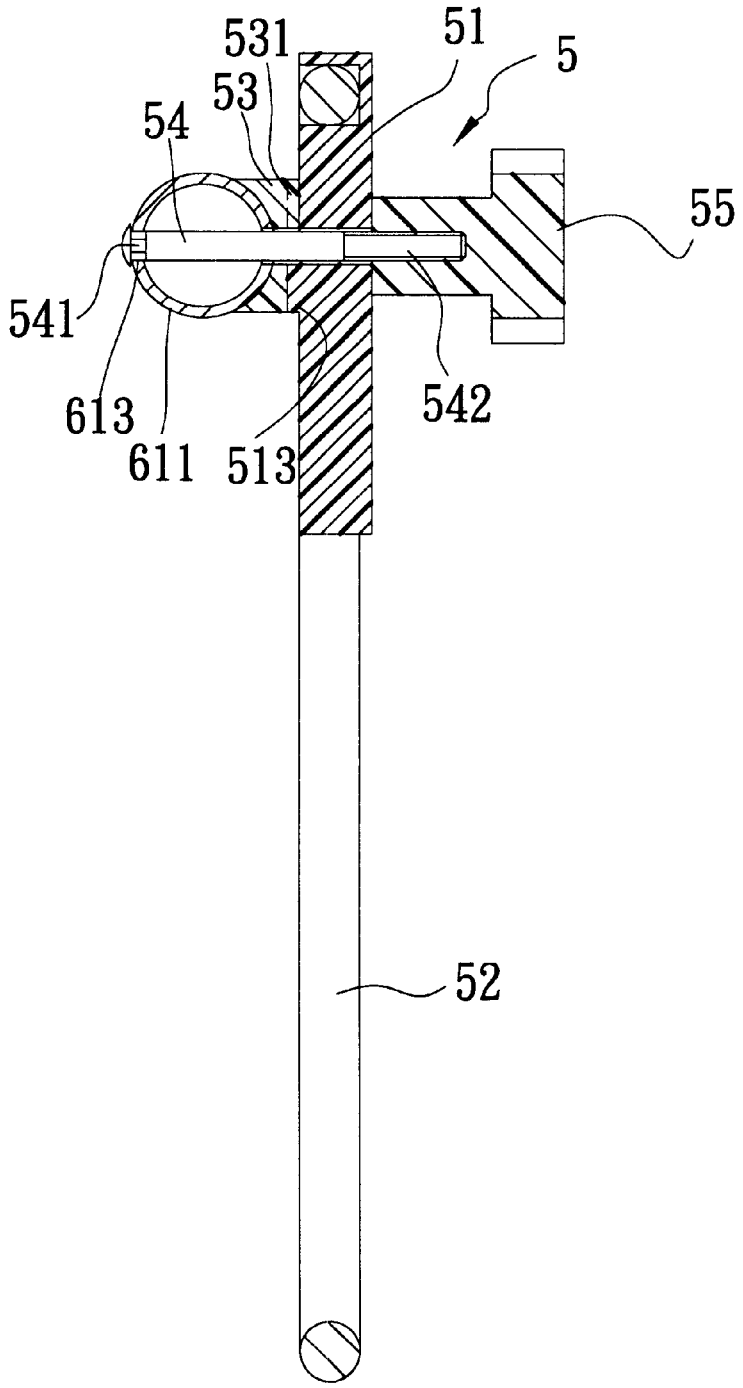
FIG. 6 is a cross-sectional view illustrating the adjustment mounting unit of the preferred embodiment.

Referring to FIGS. 4 to 6, each of the adjustable mounting units 5 is disposed between one of the lateral rods 611 and a proximate one of the insert rods 262, and includes a retaining member 53, a stationary seat 51, a pivot axle 54, and an operable rotary knob 55. The retaining member 53 is secured to the respective one of the lateral rods 611 by means of two fasteners 60, and has a curved contact face 532 that complements an outer surface of the respective lateral rod 611 for fitting contact with the latter. The retaining member 53 further has a first end face 534 opposite to the contact face 532, and a first axle hole 533 formed through the contact face 532 and the first end face 534. The first end face 534 is formed with a series of first engagement teeth 531 around the first axle hole 533. The stationary seat 51 is formed with a groove 511 for receiving an upper portion of an elongated ring hanger 52, and has a second end face 514 confronting the first end face 534 of the retaining member 53. The ring hanger 52 has parallel vertical sections 521 which cooperatively form a space that permits extension of the horizontal bar 26 therethrough and which are welded to the horizontal bar 26. The ring hanger 52 thus has a lower end portion which extends downwardly from the horizontal bar 26 and which cooperates with the horizontal bar 26 to define a hooking space 522 that permits hooking of a respective one of the three-ended upper hook members 37 at the respective ring hanger 52. The linking units 30 are thus connected pivotally to the horizontal bar 26 via the upper hook members 37 and the ring hangers 52 for suspending the seat unit 3 (see FIG. 3) above the ground surface. The stationary seat 51 is formed with a second axle hole 512 aligned with the first axle hole 533 in the retaining member 53. The second end face 514 of the stationary seat 51 is formed with a series of second engagement teeth 513 around the second axle hole 512 for engaging the first engagement teeth 531. Each of the lateral rods 611 of the canopy frame 61 is formed with a through hole 613 aligned with the first and second axle holes 533, 512. The pivot axle 54 has a head end portion 541 engaging non-rotatably the through hole 613, and a threaded second end 542 opposite to the head end portion 541. The pivot axle 54 extends in a direction transverse to the respective one of the lateral rods 611, and extends through the through hole 613, the first axle hole 533 in the retaining member 53, and the second axle hole 512 in the stationary seat 51. The threaded second end 542 of the pivot axle 54 extends through the second axle hole 512 and projects from an outer side surface of the stationary seat 51 that is opposite to the second end face 514. The rotary knob 55 is disposed adjacent to the outer side surface of the stationary seat 51, and engages threadedly the threaded second end 542 of the pivot axle 54.

Figure 7:
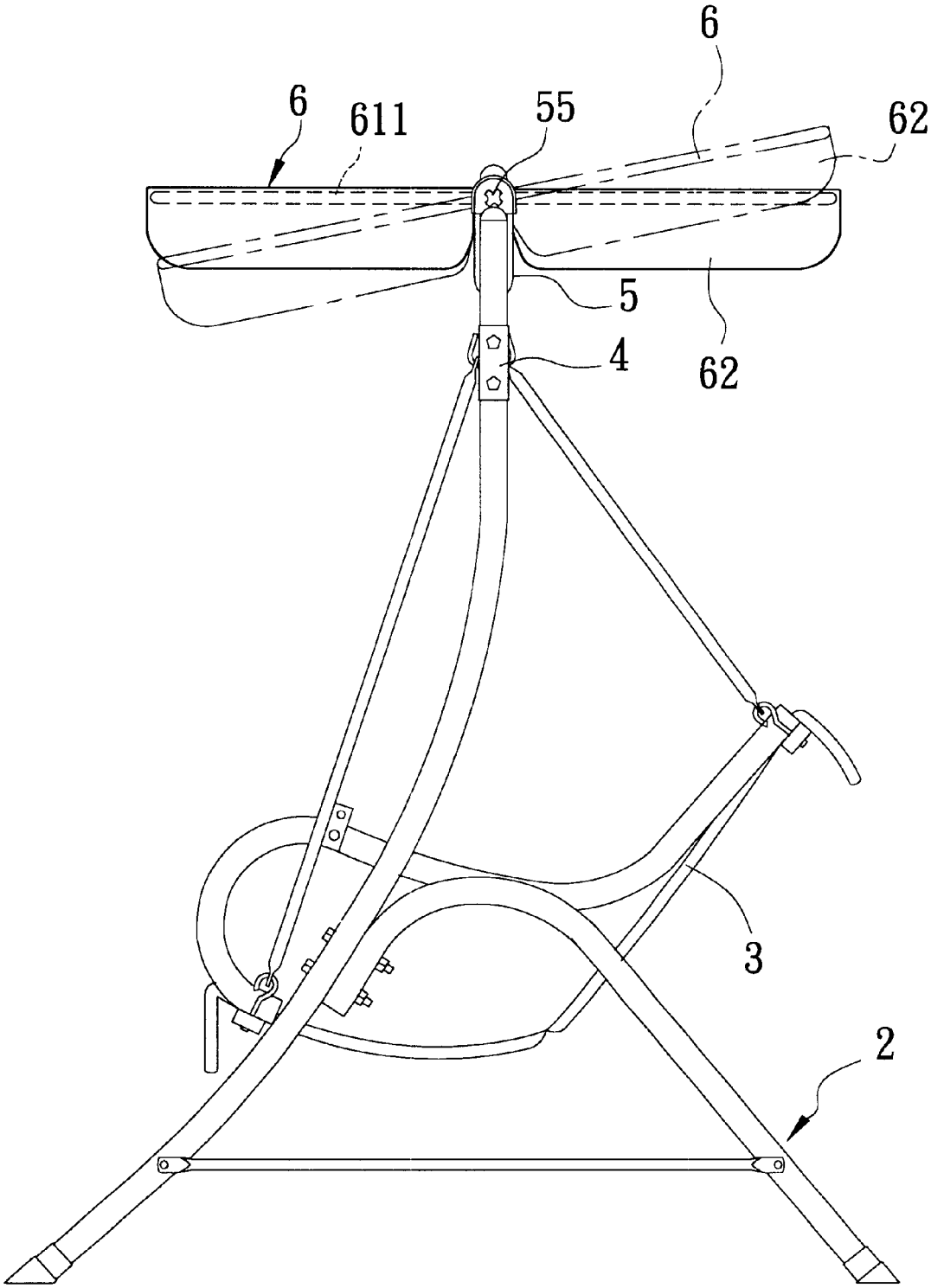
FIG. 7 is a side view of the preferred embodiment to illustrate tilting adjustment of a canopy frame thereof.

Referring to FIGS. 5 to 7, during assembly, the rotary knobs 5 are operated in a first direction for threading toward the stationary seats 51 so as to abut against the outer side surfaces of the stationary seats 51. As the head end portions 541 of the pivot axles 54 engage the lateral rods 611 of the canopy frame 61, the lateral rods 611 are pulled by the pivot axles 54 toward the stationary seats 51 to cause the first end faces 534 of the retaining members 53 to contact tightly the second end faces 514 of the stationary seats 51 so as to ensure engagement between the first and second engagement teeth 531, 513, thereby preventing rotation of the retaining members 53 together with the lateral rods 611 relative to the stationary seats 51, and thereby positioning the canopy frame 61 on the horizontal bar 26.

To adjust the inclination of the canopy 6, the rotary knobs 55 are operated in a second direction opposite to the first direction for threading away from the stationary seats 51. At this time, the canopy frame 61 reverts to its initial shape to cause the first end faces 534 of the retaining members 53 to move away from the second end faces 514 of the stationary seats 51 and to release the first engagement teeth 531 from the second engagement teeth 513, thereby permitting tip portions of the first engagement teeth 531 to move past tip portions of the second engagement teeth 513. The canopy frame 61 is then rotated to cause rotation of the retaining members 53 together with the lateral rods 611 about the axis of the pivot axles 54 relative to the stationary seats 51. When the canopy frame 61 is adjusted to a desired tilt or inclination, the rotary knobs 55 are operated once again in the first direction for abutting against the stationary seats 51 so as to position the canopy frame 61 at the desired inclination.

With the provision of the adjustable mounting units 5 for mounting the canopy frame 61 on the horizontal bar 26, the inclination of the canopy frame 61 can be adjusted by simply operating the rotary knobs 55. In the preferred embodiment, the reinforcing plates 4 strengthen the connection between the insert rods 262 and the upper ends 211 of the front legs 21 to enhance stability of the lateral frames 20 of the support frame unit 2.

While the present invention has been described in connection with what is considered the most practical and preferred embodiment, it is understood that this invention is not limited to the disclosed embodiment but is intended to cover various arrangements included within the and scope of the broadest interpretation so as to encompass all such modifications and equivalent arrangements.

I claim:

1. A swing assembly comprising:

a support frame unit including a pair of spaced-apart lateral frames with lower end portions adapted to be supported on a ground surface, and upper end portions, and a horizontal bar interconnecting said upper end portions of said lateral frames;

a seat unit disposed among said lateral frames and said horizontal bar;

a pair of linking units spaced apart along a longitudinal direction of said horizontal bar, each of said linking units having an upper end connected pivotally to said horizontal bar, and a lower end connected pivotally to said seat unit, thereby suspending said seat unit above the ground surface;

a canopy frame having a pair of lateral rods which are spaced-apart in the longitudinal direction of said horizontal bar and which are perpendicular to said horizontal bar; and a pair of adjustable mounting units for mounting a respective one of said lateral rods on said horizontal bar, each of said mounting units including a retaining member secured to the respective one of said lateral rods, said retaining member having a first axle hole formed therethrough, and a first end face formed with a series of first engagement teeth around said first axle hole, a stationary seat secured to the horizontal bar and disposed adjacent to said retaining member, said stationary seat having a second axle hole formed therethrough, said second axle hole being aligned with said first axle hole, said stationary seat further having a second end face that confronts said first end face and that is formed with a series of second engagement teeth around said second axle hole for engaging said first engagement teeth, a pivot axle having a first end secured to the respective one of said lateral rods, and a threaded second end which extends from said first end in a direction transverse to the respective one of said lateral rods through said first and second axle holes and said stationary seat, and an operable rotary knob disposed adjacent to said stationary seat opposite to said second end face and threadedly engaging said second end of said pivot axle, said rotary knob being operable in a first direction for threading toward said stationary seat to abut against said stationary seat so as to enable said first end face of said retaining member to contact tightly said second end face of said stationary seat and to enable said first engagement teeth to engage said second engagement teeth, thereby preventing rotation of said retaining member relative to said stationary seat about an axis of said pivot axle to prevent in turn rotation of said lateral rods of said canopy frame relative to said horizontal bar, said rotary knob being further operable in a second direction opposite to the first direction for threading away from said stationary seat, thereby releasing said first engagement teeth of said retaining member from said second engagement teeth of said stationary seat, and thereby permitting rotation of said retaining member together with the respective one of said lateral rods relative to said stationary seat and said horizontal bar so as to permit tilting adjustment of said canopy frame.

2. The swing assembly of claim 1, wherein said lower end portion of each of said lateral frames of said support frame unit has a vertically extending tubular connecting part with an open upper end, said upper end portion of each of said lateral frames having a vertical insert rod with a restricted lower end that is inserted axially into said tubular connecting part via said open upper end, a pair of reinforcing plates which cooperatively embrace a juncture of said tubular connecting part and said insert rod, and fasteners extending transversely through said reinforcing plates, said tubular connecting part and said insert rod for fastening said reinforcing plates, said tubular connecting part and said insert rod to one another.

3. The swing assembly as claimed in claim 1, further comprising a pair of ring hangers which extend downwardly and respectively from said stationary seats of said adjustable mounting units for connecting pivotally said upper ends of said linking units to said horizontal bar.

* * * * *